US010603544B2

(12) United States Patent
Shimizu et al.

(10) Patent No.: US 10,603,544 B2
(45) Date of Patent: Mar. 31, 2020

(54) GOLF BALL EVALUATION METHOD

(71) Applicant: BRIDGESTONE SPORTS CO., LTD., Tokyo (JP)

(72) Inventors: Takuichi Shimizu, Saitama (JP); Hirotaka Shinohara, Saitama (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 16/384,033

(22) Filed: Apr. 15, 2019

(65) Prior Publication Data

US 2019/0388729 A1 Dec. 26, 2019

(30) Foreign Application Priority Data

Jun. 21, 2018 (JP) ..... 2018-117784

(51) Int. Cl.
*A63B 24/00* (2006.01)
*A63B 69/36* (2006.01)
*A63B 102/32* (2015.01)

(52) U.S. Cl.
CPC ..... *A63B 24/0006* (2013.01); *A63B 69/3658* (2013.01); *A63B 2024/0012* (2013.01); *A63B 2024/0037* (2013.01); *A63B 2102/32* (2015.10); *A63B 2220/40* (2013.01); *A63B 2225/50* (2013.01)

(58) Field of Classification Search
CPC ..... A63B 24/0006; A63B 69/3658; A63B 2102/32; A63B 2024/0012; A63B 2024/0037; A63B 2220/40; A63B 2225/50; G01N 3/068; G01N 3/30
See application file for complete search history.

(56) References Cited

U.S. PATENT DOCUMENTS 5,245,862 A * 9/1993 Zeiss ..... G01N 3/52 73/12.01
6,231,462 B1 * 5/2001 Yamagishi ..... A63B 37/00 473/377
7,150,178 B2 * 12/2006 Bissonnette ..... A63B 47/008 73/12.01

(Continued)

FOREIGN PATENT DOCUMENTS

JP 2015-205116 11/2015
JP 2018-033703 3/2018

OTHER PUBLICATIONS

Arakawa et al., Dynamic Contact Behavior of a Golf Ball during Oblique Impact: Effect of Friction between the Ball and Target, 2007, Experimental Mechanics (2007) 47: 277-282 (Year: 2007).*

(Continued)

*Primary Examiner* — Michael D Dennis
(74) *Attorney, Agent, or Firm* — IPUSA, PLLC

(57) ABSTRACT

An evaluation method includes determining, by a computer processor, the times of occurrence of states of a golf ball during its contact with a collision surface, from the behavior of the golf ball based on its collision with the collision surface. A slide time or slide amount is calculated by the computer processor, based on the times of occurrence of the states. The slide time is a period from the start to the stop of a slide of the golf ball on the collision surface. The slide amount is the amount of the slide during the period. Information on the slide time or slide amount is output by the computer processor.

10 Claims, 11 Drawing Sheets

(56) References Cited

U.S. PATENT DOCUMENTS

| | | | | |
|---|---|---|---|---|
| 7,454,948 | B2 * | 11/2008 | Tsunoda | G01N 19/02 73/11.01 |
| 7,849,725 | B1 * | 12/2010 | Nelson | A63B 47/008 73/12.05 |
| 8,708,833 | B2 * | 4/2014 | Ueda | A63B 69/3614 473/199 |
| 9,541,483 | B2 * | 1/2017 | Ueda | G01N 3/068 |
| 2005/0261071 | A1 * | 11/2005 | Cameron | A63B 24/0003 473/219 |
| 2007/0105637 | A1 * | 5/2007 | Shimizu | A63B 24/0003 473/151 |
| 2008/0220891 | A1 * | 9/2008 | Gobush | A63B 69/3632 473/221 |
| 2013/0116808 | A1 * | 5/2013 | Molinari | A63B 69/36 700/91 |
| 2015/0306468 | A1 | 10/2015 | Ueda et al. | |
| 2016/0008676 | A1 * | 1/2016 | Uchida | A63B 53/04 473/324 |
| 2016/0379294 | A1 * | 12/2016 | Shimizu | G06Q 30/0631 705/26.7 |
| 2018/0154232 | A1 * | 6/2018 | Gentil | G06T 7/254 |
| 2019/0224552 | A1 * | 7/2019 | Kiraly | A63B 24/0021 |

OTHER PUBLICATIONS

Arakawa et al., Dynamic Contact Behavior of a Golf Ball during an Oblique Impact, 2006, Experimental Mechanics (2006) 46: 691-697 (Year: 2006).*

Arakawa et al., Dynamic Deformation Behavior of a Golf Ball during Normal Impact, 2008, Experimental Mechanics (2009) 49:471-477 (Year: 2008).*

Cross, Grip-slip behavior of a bouncing ball, 2002, American Journal of Physics 70, 1093 (2002); doi: 10.1119/1.1507792 (Year: 2002).*

Cross, Behaviour of a bouncing ball, 2015, Phys. Educ. 50 335 (Year: 2015).*

* cited by examiner

FIG.5

500

| BALL ID | IMAGE DATA | PARAMETERS | | | | POSSIBLE EVALUATION VALUES | | |
|---|---|---|---|---|---|---|---|---|
| | | CONTACT START | SLIDE START | SLIDE STOP | LEAVING | SLIDE AMOUNT AND SLIDE TIME | FIRST CONTACT TIME | SECOND CONTACT TIME |
| ID001 | $t_{10}$ $t_{11}$ $t_{12}$ ... $t_{1m}$ | | | | | | | |
| ID002 | $t_{20}$ $t_{21}$ $t_{22}$ ... $t_{2n}$ | | | | | | | |

GOLF BALL EVALUATION METHOD

CROSS-REFERENCE TO RELATED APPLICATION

This application is based on and claims priority to Japanese patent application No. 2018-117784, filed on Jun. 21, 2018, the entire contents of which are incorporated herein by reference.

BACKGROUND OF THE INVENTION

1. Field of the Invention

The present invention relates to evaluation methods.

2. Description of the Related Art

Conventionally, an observation apparatus that images how the face of a golf club hits a golf ball using a high-speed camera and observes the behavior of the golf ball at impact is known. According to this observation apparatus, it is possible to clarify differences in behavior due to differences in golf ball type. See, for example, Japanese Laid-open Patent Publication Nos. 2015-205116 and 2018-33703.

SUMMARY OF THE INVENTION

According to an aspect of the present invention, an evaluation method includes determining, by a computer processor, the times of occurrence of states of a golf ball during its contact with a collision surface, from the behavior of the golf ball based on its collision with the collision surface. A slide time or slide amount is calculated by the computer processor, based on the times of occurrence of the states. The slide time is a period from the start to the stop of a slide of the golf ball on the collision surface. The slide amount is the amount of the slide during the period. Information on the slide time or slide amount is output by the computer processor.

The object and advantages of the invention will be realized and attained by means of the elements and combinations particularly pointed out in the claims.

It is to be understood that both the foregoing general description and the following detailed description are exemplary and explanatory and not restrictive of the invention.

BRIEF DESCRIPTION OF THE DRAWINGS

FIG. 5 is a diagram illustrating examples of image information stored in an image information storage part;

DETAILED DESCRIPTION OF EMBODIMENTS

Figure 1:
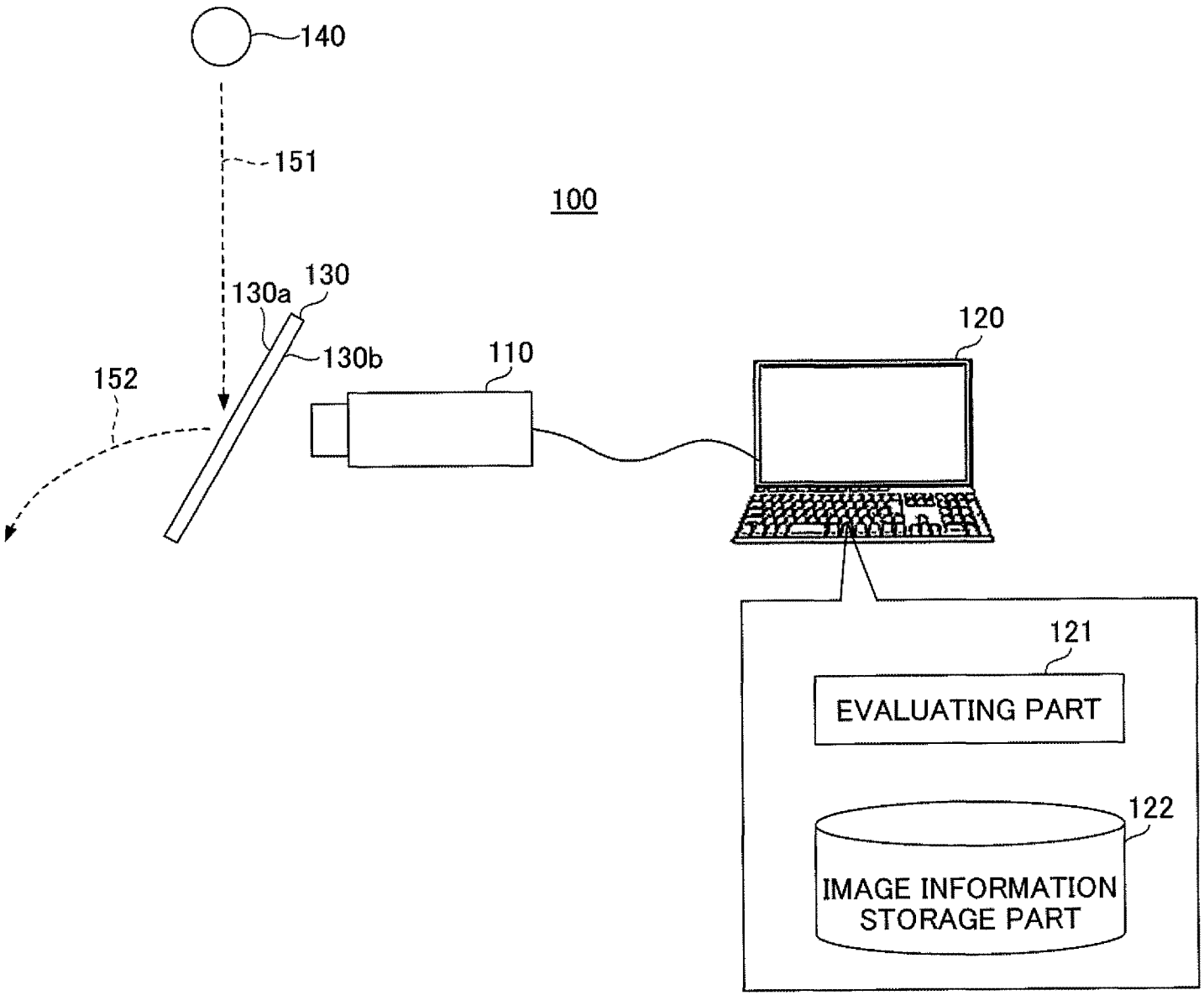
FIG. 1 is a diagram illustrating a configuration of an evaluation system.

Golfers sense differences in golf ball type as differences in a feel at impact, specifically as differences in the feeling of a ball's biting on the face of a golf club (a so-called "bite feel") and the feeling of a ball's sticking onto the face of a golf club (a so-called "sticky feel").

According to conventional observation apparatuses, however, the relationship between feel at impact and golf ball behavior is not quantified, and it is impossible to perform evaluation in line with a feel at impact.

According to an aspect of the present invention, it is possible to perform evaluation in line with a feel at impact.

Embodiments are described below with reference to the accompanying drawings. In the specification and drawings, elements having substantially the same functional configuration are referred to using the same reference numeral, and duplication description thereof is omitted.

First Embodiment

First, a configuration of an evaluation system for evaluating golf balls is described. FIG. 1 is a diagram illustrating a configuration of an evaluation system. Referring to FIG. 1, an evaluation system 100 includes an imaging unit such as a high-speed camera 110, an evaluation apparatus 120, and a collision member 130.

The collision member 130 includes a collision surface 130*a* with which a golf ball 140 collides and a surface 130*b* opposite to the collision surface 130*a*. The high-speed camera 110 images how the golf ball 140 collides with the collision surface 130*a* from the surface 130*b* side. The high-speed camera 110 transmits captured video data to the evaluation apparatus 120.

An evaluation program is installed in the evaluation apparatus 120. The evaluation apparatus 120 executes the program to operate as an evaluating part 121.

The evaluating part 121 receives the video data captured by the high-speed camera 110 and stores the received video data in an image information storage part 122. Furthermore, the evaluating part 121 displays the received video data on the evaluation apparatus 120, and receives specification from a user of the evaluation apparatus 120 with respect to the image data of frames showing the times of occurrence (occurrence times) of states of the golf ball 140 during the contact of the golf ball 140 and the collision surface 130*a*. The evaluating part 121 specifies the times of occurrence of states of the golf ball 140 from the behavior of the golf ball 140 based on its collision with the collision member 130, and stores the specified times of occurrence of states in the image information storage part 122.

Furthermore, the evaluating part 121 calculates evaluation values representing the impact feel of the golf ball 140 (described in detail below) based on the specified times of occurrence of states, and displays the calculated evaluation values on the evaluation apparatus 120.

The golf ball 140 is dropped freely from a predetermined height (for example, a height of 3 m) to collide with the collision surface 130*a* of the collision member 130. At least part of the collision member 130 with which the golf ball 140 collides is formed of a transparent member (such as acrylic glass or polycarbonate) so that the high-speed camera 110 can capture an image (video) from the side of the surface 130*b* opposite to the collision surface 130*a*.

The collision member 130 is installed such that the collision surface 130*a* has a predetermined angle to the fall direction of the golf ball 140. As a result, the golf ball 140 falling freely along a dotted arrow 151 bounces out in the direction of a dotted arrow 152 after collision with the collision member 130. (That is, the same event as striking the golf ball 140 can be reproduced.)

The golf ball 140 may be dropped manually by a user, or a predetermined dropping apparatus may be installed to automatically drop the golf ball 140.

FIG. 1 illustrates a configuration where the golf ball 140 is freely dropped to collide with the collision member 130, while the golf ball 140 may be caused to collide with the collision member 130 by installing a predetermined launching apparatus and launching the golf ball 140 from the launching apparatus.

In this case, the golf ball 140 may be launched such that a velocity at which the golf ball 140 collides with the collision member 130 is equal or nearly equal to a velocity at which a golf club impacts a golf ball when striking the golf ball. The speed of launching the golf ball 140 by the launching apparatus may be adjusted as desired by a user.

It is assumed that the angle at which the golf ball 140 collides with the collision surface 130*a* is adjusted to be equal or nearly equal to an angle at which the face of a golf club contacts a golf ball when striking the golf ball. The angle at which the golf ball 140 collides with the collision surface 130*a* may be adjusted as desired by a user.

Figure 2:
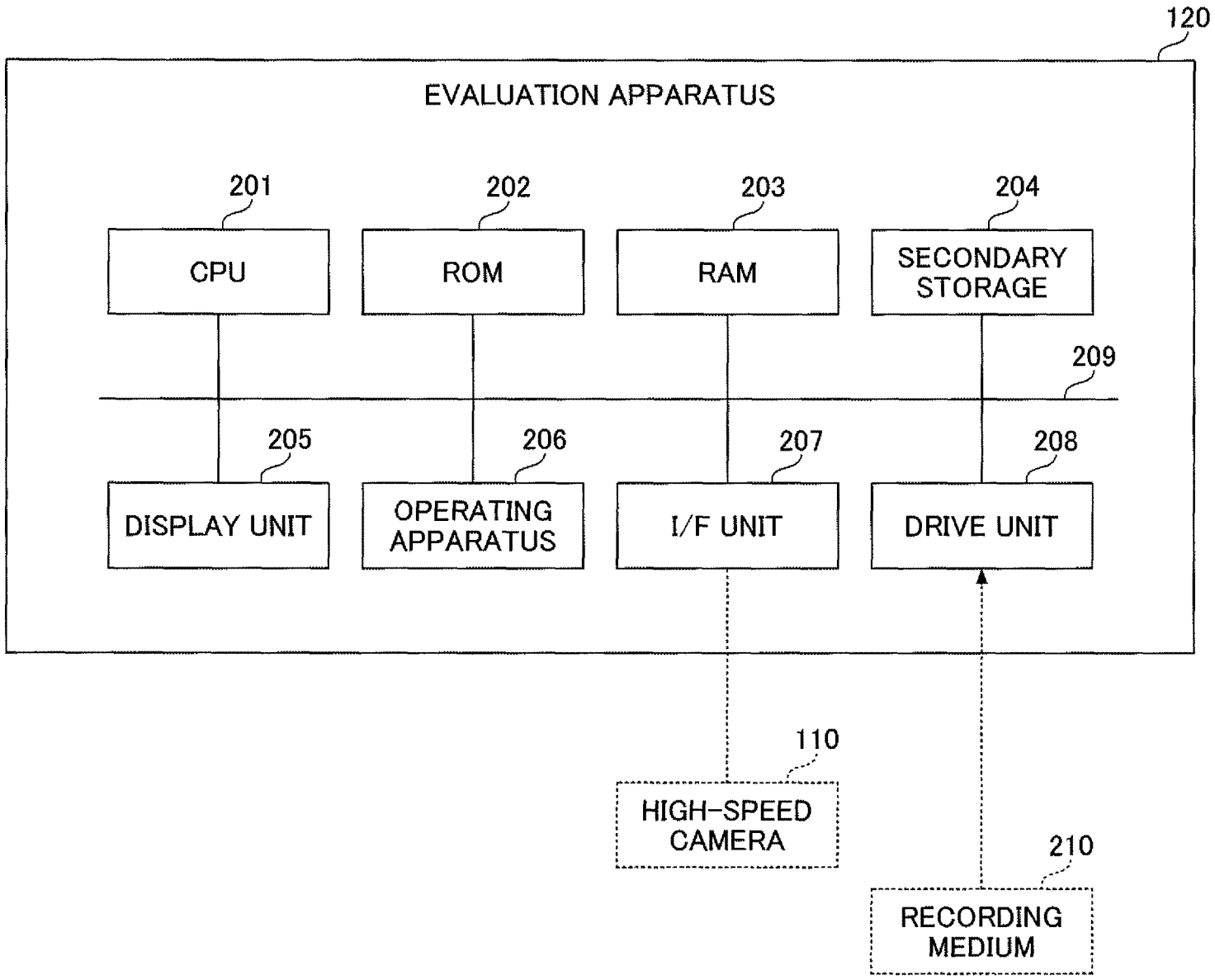
FIG. 2 is a diagram illustrating a hardware configuration of an evaluation apparatus.

Next, a hardware configuration of the evaluation apparatus 120 is described. FIG. 2 is a diagram illustrating a hardware configuration of the evaluation apparatus 120. Referring to FIG. 2, the evaluation apparatus 120 includes a central processing unit (CPU) 201, a read-only memory (ROM) 202, and a random access memory (RAM) 203. The CPU 201, the ROM 202, and the RAM 203 form a so-called computer.

The evaluation apparatus 120 further includes a secondary storage 204, a display unit 205, an operating device 206, an interface (I/F) unit 207, and a drive unit 208. The hardware items of the evaluation apparatus 120 are interconnected by a bus 209.

The CPU 201 is a computing device that executes various programs (such as the evaluation program) installed in the secondary storage 204.

The ROM 202 is a non-volatile memory. The ROM 202 serves as a primary storage that stores various programs and data that are necessary for the CPU 201 to execute various programs installed in the secondary storage 204. Specifically, the ROM 202 serves as a primary storage that stores, for example, boot programs such as a basic input/output system (BIOS) and an extensible firmware interface (EFI).

The RAM 203 is a volatile memory such as a dynamic random access memory (DRAM) or a static random access memory (SRAM). The RAM 203 serves as a primary storage that provides a work area to be expanded when the CPU 201 executes various programs installed in the secondary storage 204.

The secondary storage 204 is an auxiliary storage device that stores various programs and information generated by execution of various programs. For example, the image information storage part 122 is implemented in the secondary storage 204.

The display unit 205 is a display device that displays various screens generated by execution of the evaluation program. The operating device 206 is an input device for inputting various instructions to the evaluation apparatus 120 by a user of the evaluation apparatus 120.

The I/F unit 207 is a communication device to be connected to the high-speed camera 110 to perform communications between the evaluation apparatus 120 and the high-speed camera 110.

The drive unit 208 is a device for loading a recording medium 210. Examples of the recording medium 210 include media on which information is optically, electrically, or magnetically recorded, such as CD-ROMs, flexible disks, and magneto-optical disks, and may also include semiconductor memories in which information is electrically recorded, such as ROMs and flash memories.

For example, the recording medium 210 that has been distributed is loaded into the drive unit 208, and various programs recorded on the recording medium 210 are read by the drive unit 208 to be installed in the secondary storage 204. Various programs may be downloaded from a network into the secondary storage 204.

Figure 3:
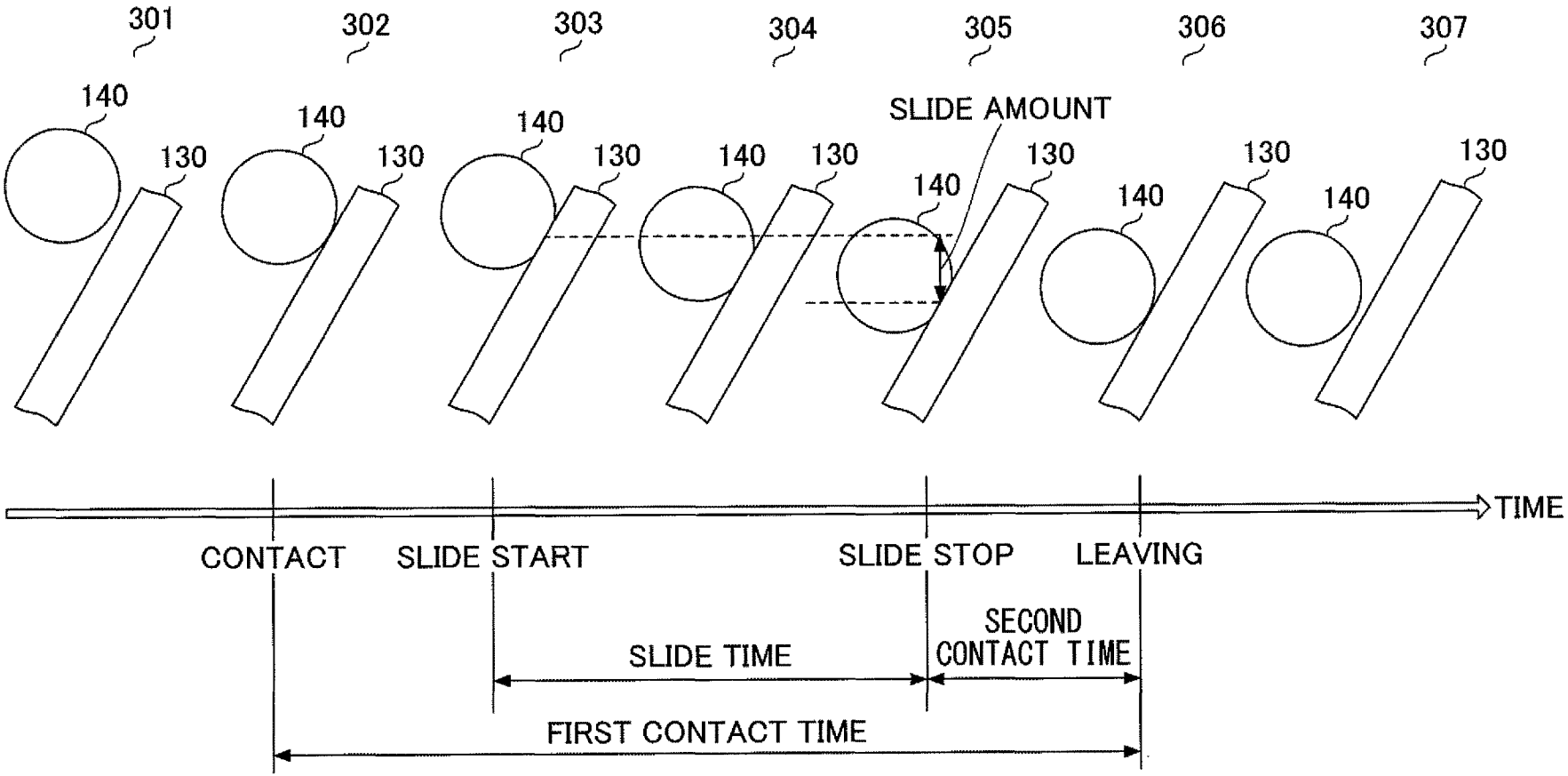
FIG. 3 is a diagram illustrating the behavior of a golf ball based on its collision with a collision surface.

Next, the behavior of the golf ball 140 based on its collision with the collision surface 130*a* is described. FIG. 3 is a diagram illustrating the behavior of the golf ball 140 based on its collision with the collision surface 130*a*.

In FIG. 3, the horizontal axis represents time, and States 301 through 307 illustrate states of the golf ball 140 at their respective times.

Of these states, State 301 illustrates the state of the golf ball 140 immediately before its collision with the collision surface 130*a* of the collision member 130.

State 302 illustrates the state of the golf ball 140 at the instant of its contact with the collision surface 130*a* of the collision member 130. The time of occurrence of State 302 is hereinafter referred to as "contact time."

State 303 illustrates the state of the golf ball 140 where the golf ball 140 partially deforms into a flat shape along the collision surface 130*a* of the collision member 130 because of its collision with the collision surface 130*a* and starts to slide along the collision surface 130*a*. The time of occurrence of State 303 is hereinafter referred to as "slide start time."

State 304 illustrates the state of the golf ball 140 where the golf ball 140 as partially flattened is moving toward the bottom of the collision surface 130*a* (sliding downward) along the collision surface 130*a*. The area of the flattened part of the golf ball 140 is greater in State 304 than in State 303.

State 305 illustrates the state of the golf ball immediately before the golf ball 140 leaves the collision surface 130*a* while rebounding to its original shape. The slide started at State 303 stops at State 305. The time of occurrence of State 305 is hereinafter referred to as "slide stop time."

State 306 illustrates the state of the golf ball 140 at the instant when the golf ball 140, which has completely regained its original shape, leaves the collision surface 130*a*. The time of occurrence of State 306 is hereinafter referred to as "leaving time."

State 307 illustrates the state of the golf ball 140 immediately after its leaving from the collision surface 130*a*.

According to this embodiment, after the behavior of the golf ball 140 is defined as described above, the behavior is quantified as described below. Specifically, as illustrated in FIG. 3, the period from the contact time (contact start time) and the leaving time (contact end time) is referred to as "first contact time." That is, the first contact time refers to a time range within which the golf ball 140 is in actual contact with the collision surface 130*a*.

Furthermore, as illustrated in FIG. 3, the period from the slide start time to the slide stop time is referred to as "slide time." That is, the slide time refers to a time range within which the golf ball 140 is sliding downward on the collision surface 130*a*. The vertical displacement of the golf ball 140 during its downward slide on the collision surface 130*a* is referred to as "slide amount."

Furthermore, as illustrated in FIG. 3, the period from the slide stop time to the leaving time is referred to as "second contact time." That is, the second contact time refers to a time range within which the golf ball 140 remains at the same position on the collision surface 130*a* immediately before leaving the collision surface 130*a*.

In the following, the slide amount or slide time, the first contact time, and the second contact time are determined as possible evaluation values in the evaluation of a golf ball.

Figure 4:
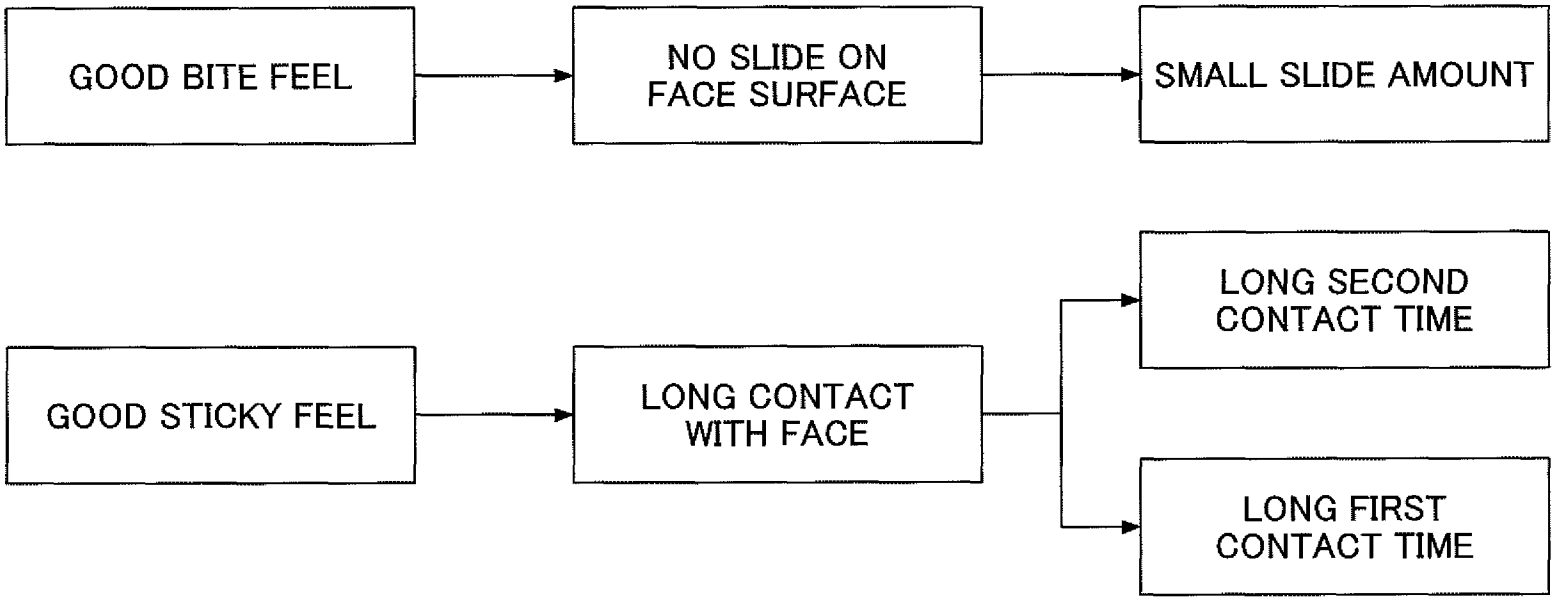
FIG. 4 is a diagram illustrating a relationship between a feel at impact and evaluation values.

Next, a relationship between a golfer's feel at impact and the above-described possible evaluation values (the slide amount or slide time, the first contact time, and the second contact time) is described. FIG. 4 is a diagram illustrating a relationship between a feel at impact and evaluation values.

As illustrated in FIG. 4, the bite feel that a golfer senses at the time of striking a golf ball is presumed to indicate an event where the golf ball does not slide much on the surface of the face of a golf club when the face of the golf club impacts the golf ball. That is, it may be said that the bite feel that a golfer senses at the time of striking a golf ball refers to a small slide amount or short slide time among the above-described possible evaluation values. Accordingly, in the following, the slide amount or slide time is used as an evaluation value that represents the bite feel.

Furthermore, the sticky feel that a golfer senses at the time of striking a golf ball is presumed to indicate an event where the golf ball is in contact with the face of a golf club for a long time when the face of the golf club impacts the golf ball. That is, it may be said that the sticky feel that a golfer senses at the time of striking a golf ball refers to a long first contact time or a long second contact time among the above-described possible evaluation values.

Golf balls having a long first contact time, however, include so-called soft golf balls that are simply low in compression. Furthermore, the first contact time is affected by the slide time. That is, the first contact time includes feelings other than the sticky feel. Accordingly, the first contact time is not necessarily proper as an evaluation value representing the sticky feel of a golf ball, and in the following, the second contact time is used as an evaluation value representing the sticky feel.

Next, specific examples of image information stored in the image information storage part 122 are described. FIG. 5 is a diagram illustrating examples of image information stored in the image information storage part 122. Referring to FIG. 5, image information 500 includes BALL ID, IMAGE DATA, PARAMETERS, and POSSIBLE EVALUATION VALUES as information items.

In BALL ID, an identifier indicating a golf ball type is stored. In IMAGE DATA, the image data of each frame of video data captured by the high-speed camera 110 is stored in correlation with time information. Time $t_{10}$ indicates the time of capture of the image data of the first frame of video data obtained by imaging a golf ball having a ball ID of ID001. The illustration of FIG. 5 shows that the image data of m+1 frames are included in the video data of the golf ball of ID001.

In PARAMETERS, CONTACT START, SLIDE START, SLIDE STOP, and LEAVING are included as further information items.

In CONTACT START, a time correlated with image data specified as the contact time by a user among the image data of the frames included in IMAGE DATA is stored.

In SLIDE START, a time correlated with image data specified as the slide start time by a user among the image data of the frames included in IMAGE DATA is stored.

In SLIDE STOP, a time correlated with image data specified as the slide stop time by a user among the image data of the frames included in IMAGE DATA is stored.

In LEAVING, a time correlated with image data specified as the leaving time by a user among the image data of the frames included in IMAGE DATA is stored.

In POSSIBLE EVALUATION VALUES, SLIDE AMOUNT AND SLIDE TIME, FIRST CONTACT TIME, and SECOND CONTACT TIME are included as further information items.

In SLIDE AMOUNT, a difference value between the position coordinates of the golf ball in its height (vertical) direction in the image data specified as the slide start time and the position coordinates of the golf ball in its height direction in the image data specified as the slide stop time is stored.

In SLIDE TIME, a difference value between the time correlated with the image data specified as the slide start time and the time correlated with the image data specified as the slide stop time is stored.

In FIRST CONTACT TIME, a difference value between the time correlated with the image data specified as the contact time and the time correlated with the image data specified as the leaving time is stored.

In SECOND CONTACT TIME, a difference value between the time correlated with the image data specified as the slide stop time and the time correlated with the image data specified as the leaving time is stored.

Figure 6:
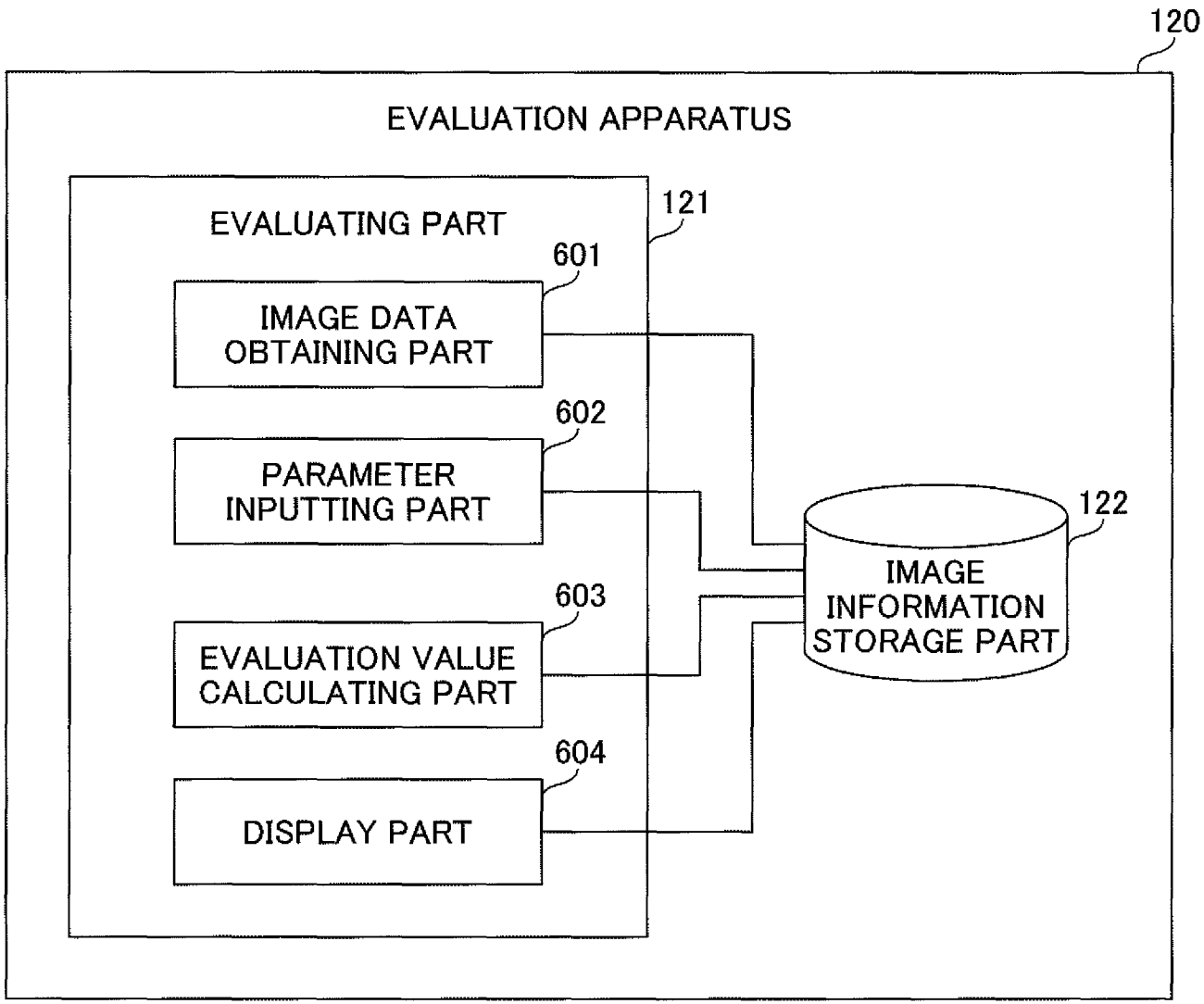
FIG. 6 is a diagram illustrating a functional configuration of an evaluating part.

Next, a functional configuration of the evaluating part 121 is described in detail. FIG. 6 is a diagram illustrating a functional configuration of the evaluating part 121. Referring to FIG. 6, the evaluating part 121 includes an image data obtaining part 601, a parameter inputting part 602, an evaluation value calculating part 603, and a display part 604.

The image data obtaining part 601 obtains video data transmitted from the high-speed camera 110, and stores the obtained video data in the image information 500 of the image information storage part 122. The image data obtaining part 601 stores the image data of frames included in the video data of a golf ball in correlation with a ball ID indicating the type of the golf ball whose video has been captured.

The parameter inputting part 602 receives specification of image data for identifying the times of occurrence of states of the golf ball 140 during its contact with the collision surface 130*a* (namely, the contact time, the slide start time, the slide stop time, and the leaving time) from a user of the evaluation apparatus 120. The parameter inputting part 602 stores the times of occurrence of states identified based on the specified image data in correlation with the ball ID in the image information 500 of the image information storage part 122.

The evaluation value calculating part 603 reads the times of occurrence of states (and their corresponding image data) stored in the image information 500 of the image information storage part 122, and calculates the slide amount and slide time, the first contact time, and the second contact time. Furthermore, the evaluation value calculating part 603 stores the calculated slide amount and slide time, first contact time, and second contact time in correlation with the ball ID in the image information 500.

The display part 604 displays the slide amount or slide time and the second contact time calculated by the evaluation value calculating part 603 on the evaluation apparatus 120 as evaluation values representing the bite feel and the sticky feel, respectively. Furthermore, the display part 604 plots a marker at a position corresponding to the calculated evaluation values in a two-dimensional plane in which the slide amount or slide time is on a vertical axis and the second contact time is on a horizontal axis, and displays the plotted marker to a user.

Figure 7A:
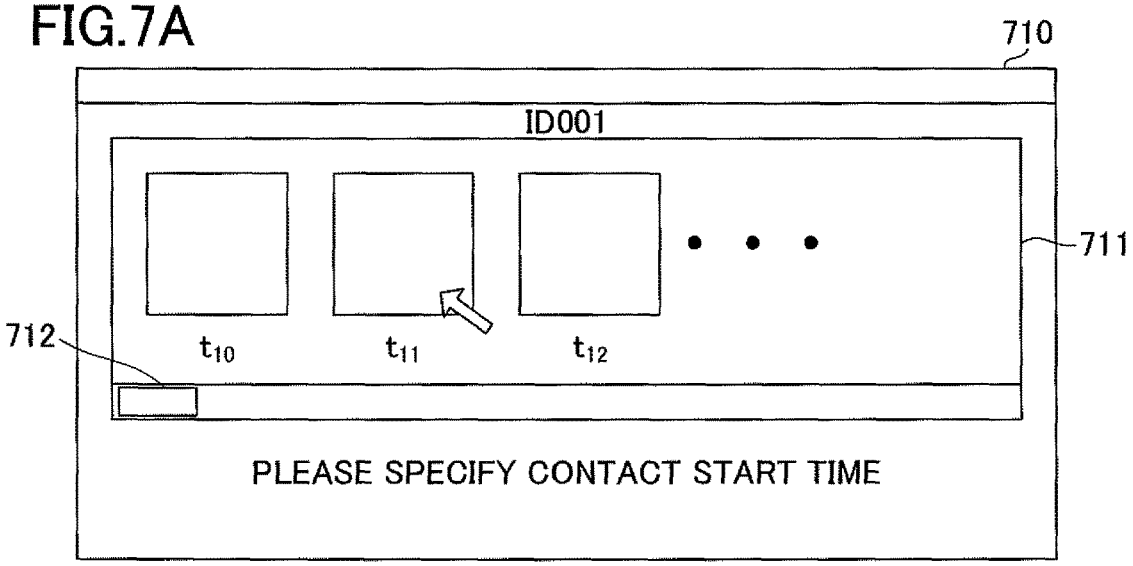
FIGS. 7A through 7C are diagrams illustrating display screens of the evaluation apparatus.
Figure 7B:
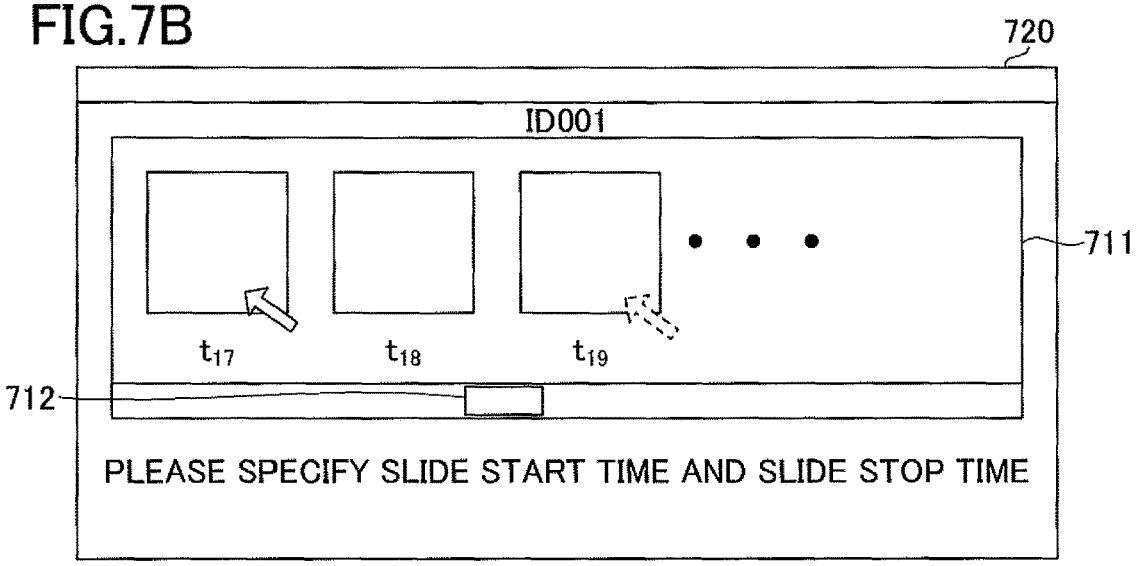
Figure 7C:
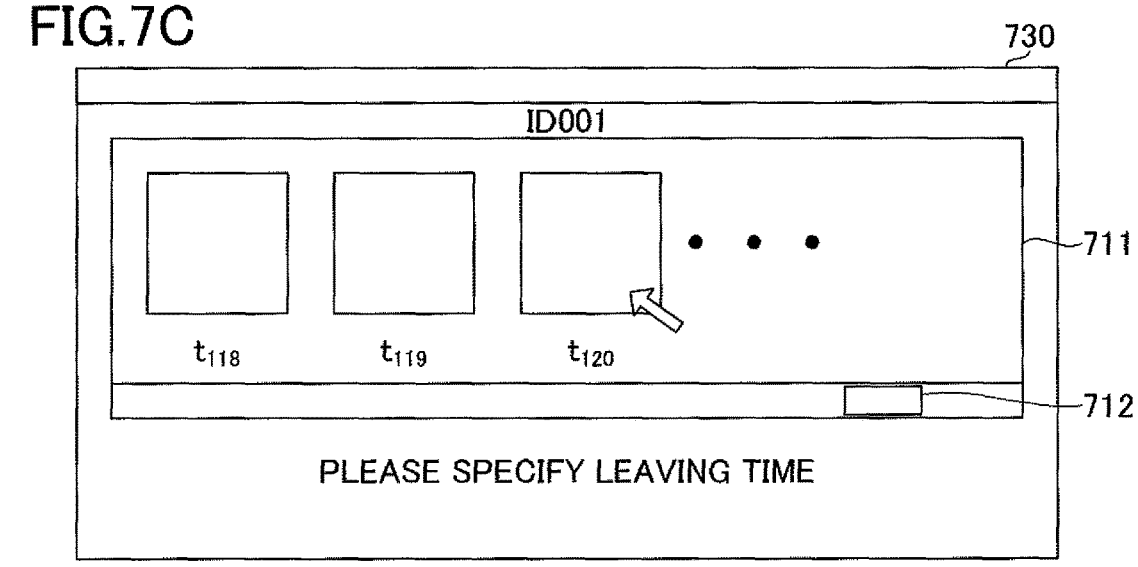

Next, display screens that the evaluating part 121 displays on the evaluation apparatus 120 when executing an evaluation process are described in detail. FIGS. 7A through 7C are diagrams illustrating display screens of the evaluation apparatus 120 that are generated by the parameter inputting part 602 and displayed on the display unit 205.

FIG. 7A illustrates a display screen that is displayed when a user specifies image data that indicate the contact time. Referring to FIG. 7A, a display screen 710 includes a display area 711 in which the image data of frames included in video data are displayed. Furthermore, the display screen 710 includes a scroll bar 712 for displaying the image data of all frames included in the video data.

When a user specifies image data that indicate the contact time on the display screen 710 illustrated in FIG. 7A, the display screen 710 switches to a display screen 720 illustrated in FIG. 7B. The display screen 720 is an example of a display screen that is displayed when a user specifies image data that indicate the slide start time and image data that indicate the slide stop time.

When the user specifies image data that indicate the slide start time and image data that indicate the slide stop time on the display screen 720 of FIG. 7B, the display screen 720 switches to a display screen 730 illustrated in FIG. 7C.

The display screen 730 is an example of a display screen that is displayed when a user specifies image data that indicate the leaving time. When the user specifies image data that indicate the leaving time on the display screen 730 of FIG. 7C, the display screen 730 switches to a display screen illustrated in FIG. 8A or 8B. The display screens illustrated in FIGS. 8A and 8B may be switched, for example, in response to a user's input.

Figure 8A:
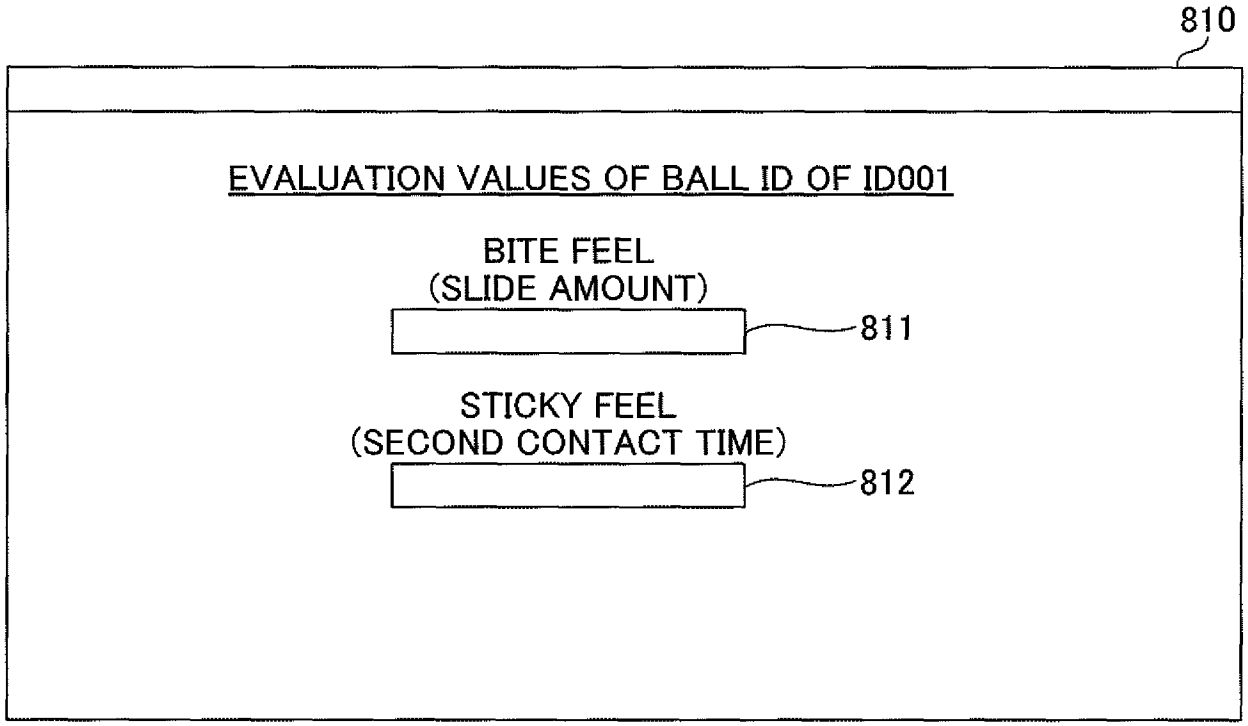
FIGS. 8A through 8C are diagrams illustrating display screens of the evaluation apparatus.
Figure 8B:
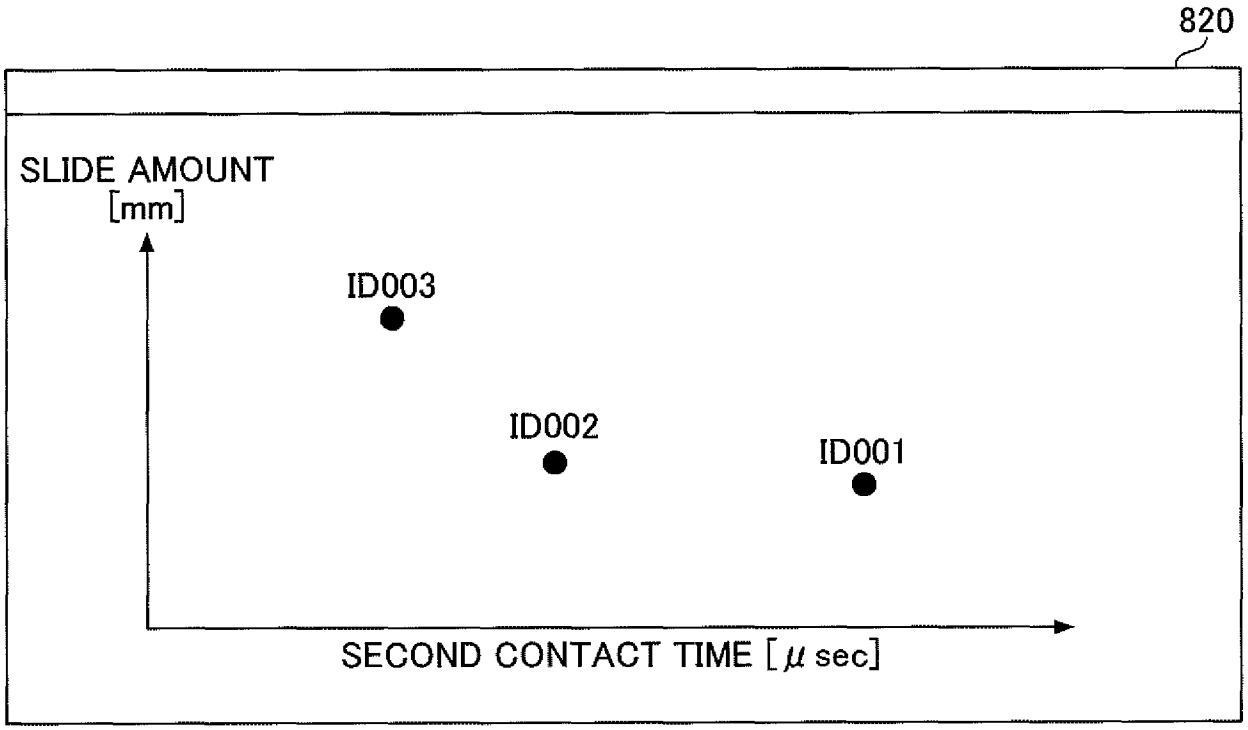

FIGS. 8A and 8B are diagrams illustrating display screens of the evaluation apparatus 120 that are generated by the display part 604 and displayed on the display unit 205. FIG. 8A illustrates a display screen 810 on which evaluation values calculated by the evaluation value calculating part 603 are displayed. Referring to FIG. 8A, the display screen 810 includes a display field 811 in which the slide amount or slide time that represents the bite feel among the evaluation values is displayed, and a display field 812 in which the second contact time that represents the sticky feel is displayed.

FIG. 8B illustrates a display screen 820 that includes a two-dimensional plane in which a marker, along with a ball ID, is plotted at a position determined by the calculated slide amount and the calculated second contact time. Referring to FIG. 8B, in the two-dimensional plane displayed on the display screen 820, the second contact time is on a horizontal axis, and the slide amount is on a vertical axis. According to the illustration of FIG. 8B, markers for other types of golf balls, along with their ball IDs, are also plotted at positions identified by their evaluation values that are already calculated.

As a result, a user of the evaluation apparatus 120 can evaluate differences in type between golf balls in line with a feel at impact.

Figure 8C:
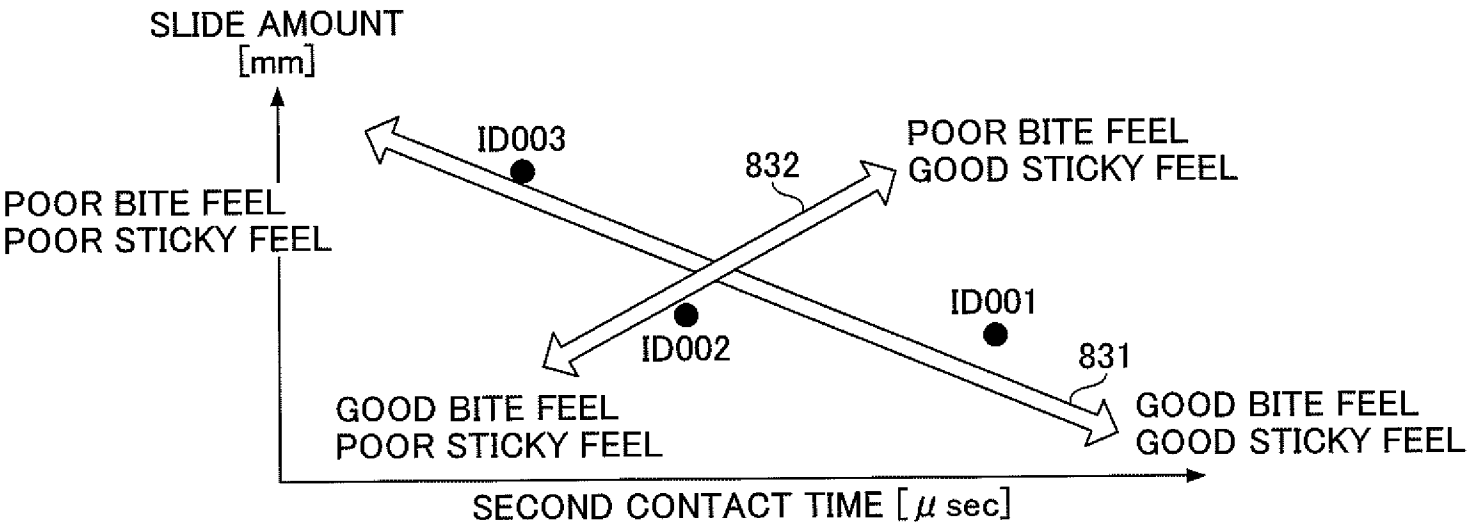

FIG. 8C is a diagram illustrating how to read the two-dimensional plane displayed on the display screen 820. As illustrated in FIG. 8C, the second contact time increases and the slide amount decreases toward the lower right of the two-dimensional plane along an arrow 831, indicating that golf balls are better in the bite feel and the sticky feel. The second contact time decreases and the slide amount increases toward the upper left of the two-dimensional plane along the arrow 831, indicating that golf balls are worse in the bite feel and the sticky feel.

Furthermore, the second contact time increases and the slide amount increases toward the upper right of the two-dimensional plane along an arrow 832, indicating that golf balls are better in the sticky feel but worse in the bite feel. The second contact time decreases and the slide amount decreases toward the lower left of the two-dimensional plane along the arrow 832, indicating that golf balls are worse in the sticky feel but better in the bite feel.

Thus, according to the evaluation apparatus 120, the bite feel and the sticky feel, which are a golfer's feel at impact, can be quantified and displayed as evaluation values (the slide amount or slide time and the second contact time).

Figure 9:
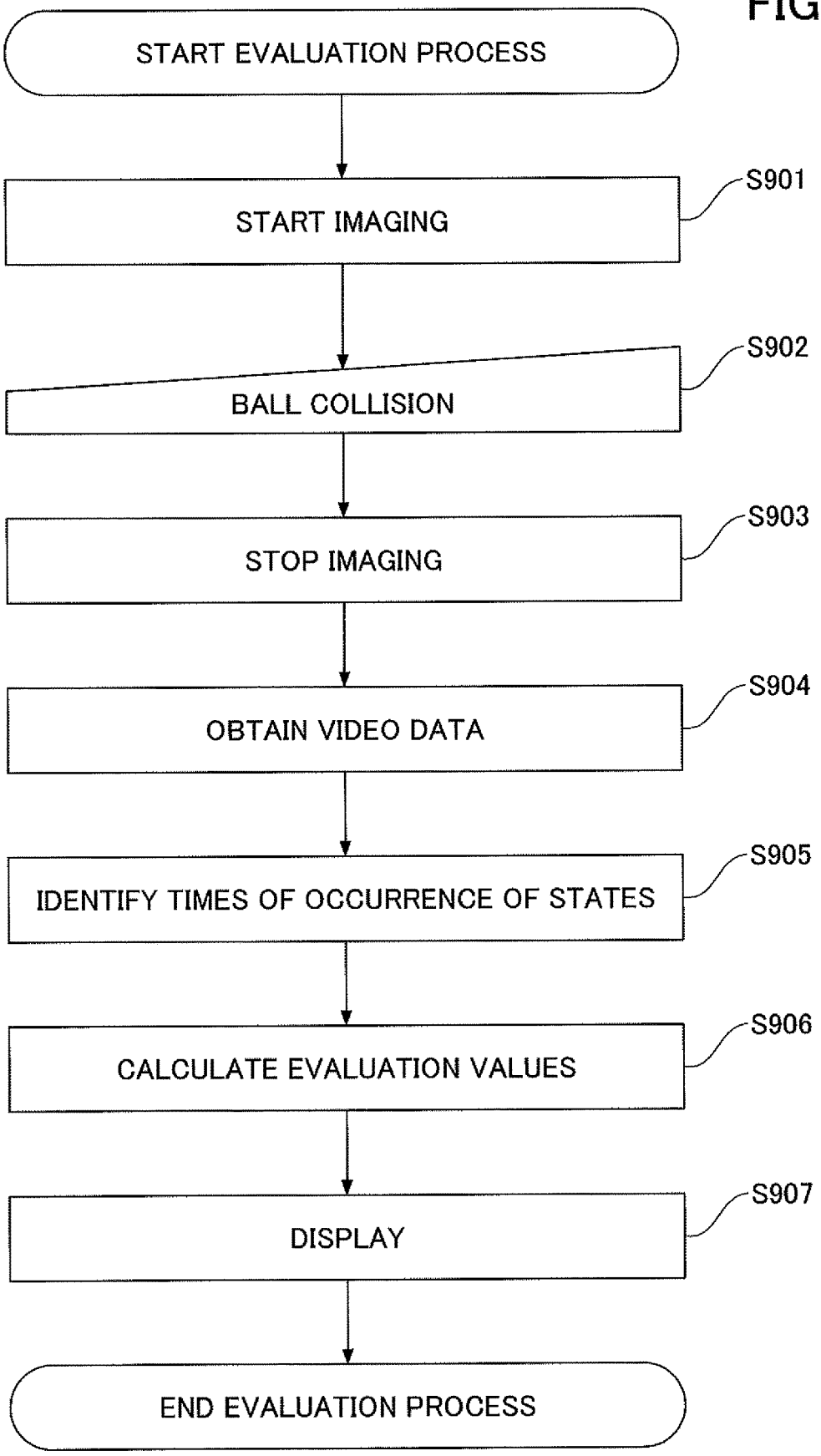
FIG. 9 is a flowchart illustrating a flow of an evaluation process by the evaluation apparatus.

Next, a flow of an evaluation process by the evaluation apparatus 120 is described. FIG. 9 is a flowchart illustrating a flow of an evaluation process by the evaluation apparatus 120. At step S901, the high-speed camera 110 starts to capture a video. At step S902, a user causes the golf ball 140 to fall and collide with the collision member 130. Thereafter, at step S903, the high-speed camera 110 stops capturing a video.

At step S904, the image data obtaining part 601 sequentially obtains video data captured by the high-speed camera 110, and stores the obtained video data in the image information 500 of the image information storage part 122.

At step S905, the parameter inputting part 602 sequentially displays the display screens 710 through 730, and receives specification of image data for identifying the times of occurrence of states of the golf ball 140 during its contact with the collision surface 130*a*. Furthermore, the parameter inputting part 602 stores the times of occurrence of states identified based on the specified image data in the image information 500 of the image information storage part 122.

At step S906, the evaluation value calculating part 603 reads the times of occurrence of states from the image information 500 of the image information storage part 122, and calculates evaluation values.

At step S907, the display part 604 displays the calculated evaluation values. Furthermore, the display part 604 plots a marker at a position identified by the calculated evaluation values in a two-dimensional plane, and displays the marker along with the ball ID of the golf ball 140. The display part 604 also displays markers for other types of golf balls that are plotted, along with their ball IDs, at positions identified by their evaluation values in the two-dimensional plane.

As is clear from the above description, according to the evaluation system 100, (a) the behavior of a golf ball based on its collision with a collision surface is imaged by a high-speed camera, and captured video data are displayed on a display screen. Then, specification of image data for determining the times of occurrence of states of the golf ball during its contact with the collision surface from the displayed behavior of the golf ball is received; and (b) the times of occurrence of states are determined based on the specified image data, and the slide time or slide amount during a period from the start to the stop of a slide of the golf ball on the collision surface is calculated based on the determined times of occurrence of states and is output.

As a result, according to the evaluation system 100, the bite feel that a golfer senses at impact can be quantified and displayed as an evaluation value (the slide time or slide amount).

Furthermore, according to the evaluation system 100, (c) the times of occurrence of states are determined based on the specified image data, and the second contact time, which is a period from the stop of a slide of the golf ball on the collision surface to the time of leaving of the golf ball from the collision surface, is calculated based on the determined times of occurrence of states and is output.

As a result, according to the evaluation system 100, the sticky feel that a golfer senses at impact can be quantified and displayed as an evaluation value (the second contact time).

Consequently, the evaluation system 100 makes it possible to evaluate a golf ball in line with a feel at impact (the bite feel and the sticky feel).

Second Embodiment

According to the first embodiment, when receiving specification of image data for determining the times of occurrence of states of the golf ball during its contact with the collision surface, the image data of frames of video data are displayed in an array. The method of receiving specification, however, is not limited to this.

For example, image data for determining the times of occurrence of states of the golf ball during its contact with the collision surface may alternatively be specified by reproducing video data on a display screen and letting a user click on the display screen when image data corresponding to the states are displayed.

Furthermore, according to the first embodiment, the evaluation value calculating part 603 automatically calculates evaluation values based on image data specified by a user. The method of calculating evaluation values, however, is not limited to this.

For example, the slide amount may be manually measured by a user on a display screen.

Furthermore, according to the first embodiment, the display part 604 is described as generating a two-dimensional plane in which the slide amount or slide time is on a vertical axis and the second contact time is on a horizontal axis. The method of generating a two-dimensional plane, however, is not limited to this. For example, the display part 604 may generate a two-dimensional plane in which normalized values of the slide amount or slide time are on a vertical axis and normalized values of the second contact time are on a horizontal axis.

Furthermore, the evaluation apparatus 120, which is described as calculating the slide amount or slide time according to the first embodiment, may calculate both of the slide amount and the slide time.

Furthermore, while the time of occurrence of State 302 is determined as the contact time and the time of occurrence of State 303 is determined as the slide start time according to the first embodiment, the time of occurrence of State 302 may alternatively be determined as the slide start time. That is, the contact time may be equated to the slide start time.

Furthermore, while the time of occurrence of State 305 is determined as the slide stop time according to the first embodiment, alternatively, focusing on a velocity component, a time at which the drop velocity of a golf ball before contacting the collision surface 130*a* is reduced by a preset proportion may be determined as the slide stop time. This makes it possible to set the slide stop time using deceleration in a sliding direction as an indication.

Furthermore, while not mentioned in the first embodiment, a predetermined mark may be put on a golf ball to make it easier for a user to specify image data when specifying image data based on displayed image data. Furthermore, a golf ball may include a built-in accelerometer, and the evaluation apparatus 120 may display an acceleration value in correlation with image data.

Furthermore, while one type of collision member is installed as the collision member 130 according to the first embodiment, multiple collision members whose collision surfaces have different coefficients of friction may be prepared, and evaluation values may be calculated for various types of golf balls while changing the collision members.

Furthermore, according to the first embodiment, the evaluation apparatus 120 displays the slide amount or slide time and the second contact time on the display screen 810 as evaluation values. The evaluation values displayed on the display screen 810, however, are not limited to these, and the evaluation apparatus 120 may display, for example, a value calculated based on the slide amount or slide time (information on the slide amount or slide time) and a value calculated based on the second contact time (information on the second contact time). Furthermore, the information on the slide amount or slide time may include the result of calculating the slide amount or slide time, for example.

Furthermore, the evaluation apparatus 120, which excludes the first contact time from evaluation values and does not display the first contact time on the display screen 810 according to the first embodiment, may also display the first contact time on the display screen 810.

Furthermore, according to the first embodiment, the evaluation apparatus 120 is described as displaying evaluation values on the display screen 810. The method of outputting evaluation values, however, is not limited to this, and evaluation values may be audibly output.

Furthermore, according to the first embodiment, the evaluation system 100 is described as capturing a video of the behavior of the golf ball 140 based on its collision with the collision surface 130*a* using the high-speed camera 110. The method of observing the behavior of the golf ball 140, however, is not limited to this, and the evaluation system 100 may, for example, form the collision surface 130*a* with a measuring apparatus such as a force plate, and observe the behavior of the golf ball 140 by measuring a force applied onto the force plate. This is because the times of occurrence of states of the golf ball 140 during its contact with the collision surface 130*a* can be determined from the results of measurement of a force applied onto the force plate.

As an evaluation value in the case of measuring a force applied to the force plate, the evaluation apparatus 120 may calculate, for example, information on the slide time={(a force applied to the force plate at the slide stop)−(a force applied to the force plate at the slide start)}/(the slide time).

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. An evaluation method comprising:

receiving, by a computer processor, video data of behavior of a golf ball based on a collision of the golf ball with a collision surface;

receiving, by the computer processor, specification of image data in the received video data;

determining, by the computer processor, times of occurrence of states of the golf ball during contact of the golf ball with the collision surface, based on the specification of the image data;

calculating, by the computer processor, a slide time or a slide amount based on the times of the occurrence of the states, the slide time being a period from a start to a stop of a slide of the golf ball on the collision surface, the slide amount being an amount of the slide during the period;

outputting, by the computer processor, information on the slide time or the slide amount; and displaying, by the computer processor, the received video data on a display device, wherein said receiving the specification of the image data receives the image data specified in the received video data displayed on the display device.

2. The evaluation method as claimed in claim 1, wherein said determining determines the times of the occurrence of the states in response to the image data of frames that show the occurrence of the states being specified in the received video data.

3. The evaluation method as claimed in claim 1, wherein the specification of the image data specifies the image data as a time of the start of the slide and a time of the stop of the slide.

4. An evaluation method comprising:

receiving, by a computer processor, video data of behavior of a golf ball based on a collision of the golf ball with a collision surface;

receiving, by the computer processor, specification of image data in the received video data;

determining, by the computer processor, times of occurrence of states of the golf ball during contact of the golf ball with the collision surface, based on the specification of the image data;

calculating, by the computer processor, a contact time based on the times of the occurrence of the states, the contact time being a period from a stop of a slide of the golf ball on the collision surface to leaving of the golf ball from the collision surface;

outputting, by the computer processor, information on the contact time; and displaying, by the computer processor, the received video data on a display device, wherein said receiving the specification of the image data receives the image data specified in the received video data displayed on the display device.

5. The evaluation method as claimed in claim 4, wherein said determining determines the times of the occurrence of the states in response to the image data of frames that show the occurrence of the states being specified in the received video data.

6. An evaluation method comprising:

receiving, by a computer processor, video data of behavior of a golf ball based on a collision of the golf ball with a collision surface;

receiving, by the computer processor, specification of image data in the received video data;

determining, by the computer processor, times of occurrence of states of the golf ball during contact of the golf ball with the collision surface, based on the specification of the image data;

calculating, by the computer processor, a slide time or a slide amount based on the times of the occurrence of the states, the slide time being a period from a start to a stop of a slide of the golf ball on the collision surface, the slide amount being an amount of the slide during the period;

outputting, by the computer processor, information on the calculated slide time or slide amount;

calculating, by the computer processor, a contact time based on the times of the occurrence of the states, the contact time being a period from the stop of the slide of the golf ball on the collision surface to leaving of the golf ball from the collision surface;

outputting, by the computer processor, information on the calculated contact time; and displaying, by the computer processor, the received video data on a display device, wherein said receiving the specification of the image data receives the image data specified in the received video data displayed on the display device.

7. The evaluation method as claimed in claim 6, further comprising:

displaying, by the computer processor, a marker at a position identified by the information on the calculated slide time or slide amount and the information on the calculated contact time in a two-dimensional plane in which the information on the calculated slide time or slide amount is on a vertical axis and the information on the calculated contact time is on a horizontal axis.

8. The evaluation method as claimed in claim 6, wherein said determining determines the times of the occurrence of the states in response to the image data of frames that show the occurrence of the states being specified in the received video data.

9. The evaluation method as claimed in claim 6, wherein said determining determines a time of a start of the contact, a time of the start of the slide, a time of the stop of the slide, and a time of the leaving.

10. The evaluation method as claimed in claim 9, further comprising:

calculating, by the computer processor, another contact time based on the times of the occurrence of the states, said another contact time being a period from the start of the contact to the leaving of the golf ball; and outputting, by the computer processor, information on said calculated another contact time.

* * * * *